US005669085A

United States Patent [19]

Wilson

[11] Patent Number: 5,669,085

[45] Date of Patent: Sep. 23, 1997

[54] WATER-RESISTANT MULTIFUNCTIONAL BATHROOM FIXTURE

[76] Inventor: David W. Wilson, 340 Long Meadow Way, Arnold, Md. 21012

[21] Appl. No.: 666,826

[22] Filed: Jun. 19, 1996

[51] Int. Cl.[6] ..... A47K 5/02

[52] U.S. Cl. ..... 4/605; 4/559; 4/628; 206/77.1

[58] Field of Search ..... 4/559, 605, 661, 4/628; 206/77.1; 312/229, 245, 246, 248, 293.2, 206, 207, 284, 294, 119

[56] References Cited

U.S. PATENT DOCUMENTS

| | | | |
|---|---|---|---|
| 609,725 | 8/1898 | Baker | 206/77.1 |
| 1,951,585 | 3/1934 | Tomson et al. | 312/206 |
| 2,549,115 | 4/1951 | Mote | 312/207 |
| 2,642,331 | 6/1953 | Sprinkle | 312/206 |
| 2,712,487 | 7/1955 | Miller | 312/206 |
| 3,022,602 | 2/1962 | Turek et al. . | |
| 3,023,067 | 2/1962 | Maassen | 4/628 |
| 3,054,211 | 9/1962 | Hawk et al. | 206/77.1 |
| 3,063,190 | 11/1962 | Adelson . | |
| 3,323,850 | 6/1967 | Link . | |
| 4,300,248 | 11/1981 | Dworkin . | |
| 4,313,537 | 2/1982 | Collet . | |
| 4,654,901 | 4/1987 | Garcia . | |
| 5,509,529 | 4/1996 | Kelley | 206/77.1 |

FOREIGN PATENT DOCUMENTS

| | | | |
|---|---|---|---|
| 2410282 | 9/1975 | Germany | 4/605 |

*Primary Examiner*—Henry J. Recla
*Assistant Examiner*—Charles R. Eloshway
*Attorney, Agent, or Firm*—Breneman & Georges

[57] ABSTRACT

A multifunctional water-resistant bathroom fixture is provided for multiple utilitarian applications in the bathroom including use as a water-resistant bathroom soap holder and bathroom tissue dispenser for coordinating the bathroom shower area. The multifunctional bathroom fixture includes a wall mounting bracket or frame for carrying a pivotal sloping cover and a water-resistant closure device disposed between the sloping cover and wall mounting frame. The wall mounting frame may include sloping sides conforming to the configuration of the sloping cover to provide a soap dish or bathroom tissue closure that is resistant to water and adaptable to a wide variety of applications in the home.

18 Claims, 6 Drawing Sheets

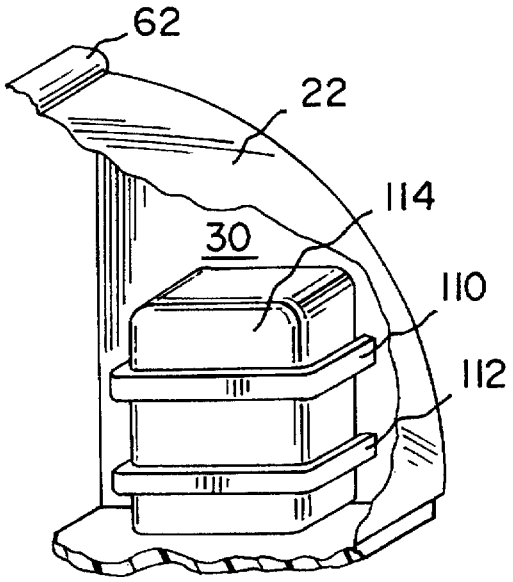
FIG. 12
FIG. 13
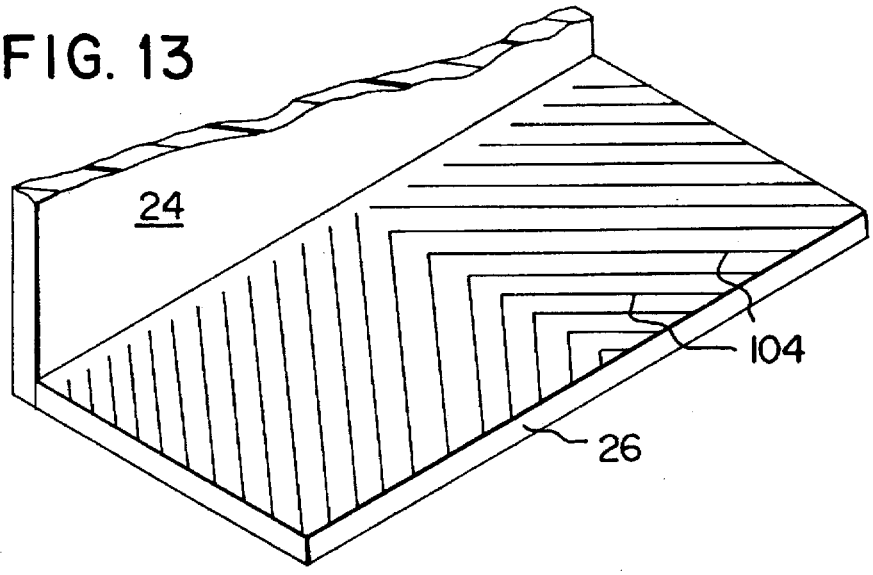
FIG. 14
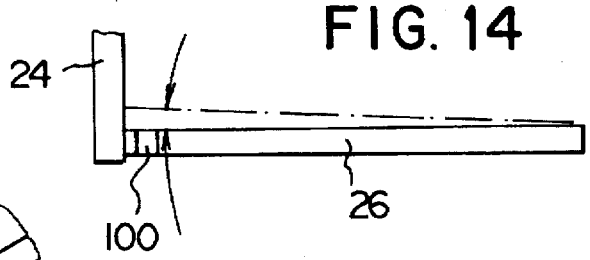
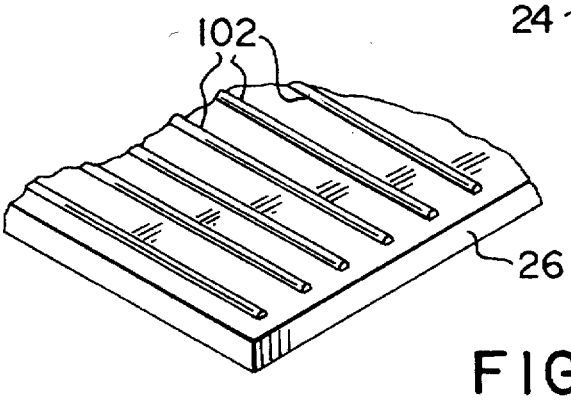
FIG. 15

WATER-RESISTANT MULTIFUNCTIONAL BATHROOM FIXTURE

BACKGROUND OF THE INVENTION

1. Field of the Invention

The present invention pertains to a water-resistant multifunctional bathroom fixture which may be utilized as either or for both providing a water-resistant soap dish holder or as a bathroom tissue fixture which prevents water spray from interfering with soap or bathroom tissue located in the bathroom. More particularly, the invention contemplates a multifunctional water-resistant device having a pivotal sloping cover conforming to the sides of a wall attachment mounting frame. The pivotal cover in the preferred embodiment nests into the sides of the wall attachment mounting frame to ensure water spray, splashing or dousing of water results in the water being directed away from items placed within the water-resistant fixture in the bathroom.

2. Description of Related Prior Art

Conventional showers and bathrooms include a shower area which generally employs a ceramic tiled bathroom and bathtub with a shower curtain which is also in general proximity of bathroom tissue holders and subject to water-splashing. In many ceramic tiled bathroom/bathtub arrangements a soap dish holder is built into the wall which includes a handle and a soap dish for holding soap. A number of the prior art devices provide a closure for the built-in holder which covers the handle. Further, in many bathrooms adjacent to the shower is a bathroom tissue holder which in most instances does not include a water-splash shield. In some bathrooms a shielded pivotal bathroom tissue cover is provided which assists in preventing water splashes onto toilet tissue which cover also assists in providing for the tearing of the bathroom tissue. Unlike the present invention the prior art has not provided a device which functions both as a water-resistant soap dish container and bathroom tissue dispenser for protecting bathroom tissue.

Numerous conventional devices are available in the prior art for covering the conventional bathtub/shower soap holding fixture to reduce the amount of water collected in the fixture during showering. One such device for covering a conventional shower soap holder and handle is U.S. Pat. No. 4,654,901. This device, unlike the present invention is intended for a conventional soap holding fixture and is designed to reduce the amount of water splashed into the soap tray to prevent deterioration of the stored soap. One of the disadvantages of such devices is that it obstructs the built-in handle preventing use in an emergency. Another disadvantage is that the built-in fixture is enclosed and does not allow sufficient aeration or drying of wet used soap placed in the covered conventional soap holding fixture.

Devices such as Garcia U.S. Pat. No. 4,654,901, Dworkin U.S. Pat. No. 4,300,248, Turek, et al. U.S. Pat. No. 3,022,602 and Link U.S. Pat. No. 3,323,850 all pertain to such insert devices for use with conventional bathroom soap holding fixtures to reduce the amount of water. In many of these devices a pivotal or shielding-type cover is provided to reduce the amount of water in the conventional soap holding fixture and prevent deterioration and the dissolving of the soap in the soap dish.

Unlike the invention the insert devices of the prior art are not multifunctional and susceptible to multiple applications in the bathroom and are not self-standing units. Further such prior art devices interfere with the built-in handle and the closing off of built-in recess retards drying of wet bars of soap placed in the closed conventional soap holding fixture.

In addition such prior art devices do not provide for a multifunctional use for other applications in the bathroom for decorative and utilitarian functions.

The prior art also includes stand alone soap holding devices for holding, drying and repetitively dispensing soap such as in Collet U.S. Pat. No. 4,313,537. Such stand alone devices are not subject to the moisture entrapment problem inherent in the conventional bathtub/shower soap holding fixtures but also do not provide a water-resistant closure during showering. Further, such devices do not provide the advantages of having additional applications and uses in the bathroom environment. In addition such devices are not readily amenable to decorative and coordinated applications in the bathroom environment.

Additional conventional self-standing soap receptacles which have been utilized in the prior art for decorative applications in the bathroom include U.S. Pat. No. 3,063,190 which is a soap receptacle primarily designed for children. Such prior art soap receptacles have the advantage of decoration and holding the interest for children in the bathroom. These devices are not multifunctional and do not have multiple applications in the bathroom environment. Further, such devices are not water-resistant and allow the admission of water in the closure, either as a result of water splashed into the closure, or as a result of wet soap being placed in the closure. Such prior art soap dishes also do not provide for water channelling and water drainage away from soap bars placed within the prior art soap dish closures. These prior art devices are not multifunctional and traditionally have been designed for use only in the bathtub or shower as a soap dish.

SUMMARY OF THE INVENTION

The invention pertains to a multifunctional bathroom device which may be utilized either to provide a water-resistant closure for soap used in the bathtub or shower or in the bathroom as a bathroom tissue cover to provide a water-resistant closure for the bathroom environment. The novel multifunctional bathroom device may further include a removable shelf and optional recesses in the sides to provide support for engaging an expandable bathroom tissue roller. In further embodiments of the invention the wall attachment mounting frame may include mounting means for mounting directly to the wall over most standard size bathroom tissue dispensers.

The multifunctional bathroom device is water-resistant and prevents water from entering into the self-sufficient closure by employing a substantially rectangular wall mounting frame which in the preferred embodiment includes curved sloping sides. The sloping sides slope from the wall mounting frame at the upper end to the width of the soap-supporting shelf at the lower end. The sloping sides are disposed substantially parallel to each other at a distance sufficient to span the length of the soap-supporting shelf. A pivotal cover is then attached to either the sloping sides or to the wall mounting frame in such a manner that the pivotal sloping cover spans to cover and over and around the soap supporting shelf. The pivotal sloping cover also extends laterally over each of the sides to prevent water from entering into the water-resistant soap closure.

The attachment of the pivotal sloping cover can be affixed to both of the sloping sides, in which case a provision is made for an overhang sufficient to prevent water from entering into the water-resistant closure. Alternatively, the sloping cover can be attached to the wall attachment mounting frame with a smaller overhang so as to prevent shower water or water splashed directly on the pivotal sloping cover from entering into the water-resistant closure.

The pivotal sloping cover in its preferred application includes a ball and socket-type hinge which is recessed and which further assists in preventing water from entering into the water-resistant closure. The ball and socket hinge in the preferred application include means for maintaining the pivotal sloping cover in an open position by the utilization of a spring-loaded bar and detente arrangement to allow the pivotal sloping cover to remain in an open condition when the soap is removed from the water-resistant closure. The pivotal sloping cover may further include exterior water-channelling grooves to assist in the channelling of water away from the pivotal sloping cover and away from the water-resistant closure.

The novel water-resistant multifunctional bathroom fixture may further include a removable soap shelf which may include a spring-biased locking means for locking the shelf to the mounting frame. The soap shelf may further include drainage holes, drainage channels and be tilted to assist in the removal and channelling of water from wet soap placed in the water-resistant container. The utilization of drainage holes and tilting provides for aeration and preventing water from remaining in the water-resistant closure and from dissolving soap stored therein. In addition, the sloping sides may include recesses for receiving an expandable bathroom tissue roller so that the multifunctional water-resistant closure can be utilized and coordinated for both, in the shower use and in the bathroom use as a toilet tissue holder, to prevent bathroom tissue from becoming water-damaged. In addition removable mounting brackets may be placed in one or both of the sides to hold soap that can be stored in the water-resistant multifunctional container.

The water-resistant closure device of the invention further may utilize a sloping cover that is curvilinear or may be curved in a non-linear sloping configuration cover to accommodate various external designs and for purposes of decorative and bathroom motif coordination. The sloping cover may further include recesses or other externally formed shelfs for holding shampoo bottles, razors or other bathroom paraphernalia while soap is stored within the water-resistant closure during periods of non-use.

The sloping cover may slope downwardly and laterally so that the edges of the sloping cover mate with the wall attachment mounting frame to provide a water-resistant closure. In this embodiment the wall attachment mounting frame preferably includes a corresponding groove or recess for receiving the edges of the sloping cover to provide a water-resistant closure. These and other changes, modifications and adaptations of the invention will be described in greater detail with respect to the Description of the Drawings.

BRIEF DESCRIPTION OF THE DRAWING

The objects and advantages of the invention will become apparent to those skilled in the art from the following detailed description of the invention when read in conjunction with the accompanying drawings in which:

FIG. 12 is a fragmentary side view illustrating removable brackets for maintaining extra soap in the novel multifunctional water-resistant bathroom fixture;

FIG. 13 is a fragmentary perspective view illustrating water channels in the soap shelf;

FIG. 14 is a fragmentary side elevational view illustrating a tilting of the soap shelf to assist in water removal;

FIG. 15 is a perspective fragmentary view of a portion of the soap shelf of FIG. 14 with water channelling holes;

DESCRIPTION OF THE PREFERRED EMBODIMENTS

The invention pertains to a multifunctional water-resistant bathroom fixture having a wall mounting frame and a sloping pivotal cover together with a water-resistant closure between the sloping cover and sides of the wall mounting frame. The water-resistant closure between the sloping cover and mounting frame can be disposed in the best mode between the sloping sides projecting from the wall mounting frame and the sloping cover or in the wall mounting frame where the sloping cover incorporates the sides. The sides of the sloping cover may be perpendicular to the sloping cover or the sloping cover may slope downwardly and laterally to enclose the sides of the wall mounting frame as well as a shelf extending from the wall mounting frame.

Figure 20:
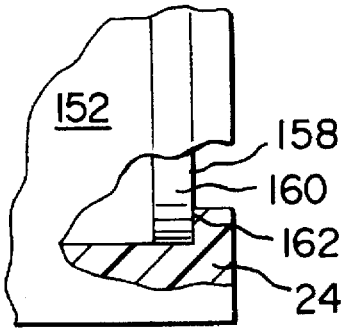
FIG. 20 is a fragmentary top plan view partly in section illustrating the closure of the sloping cover of FIG. 19 at circled bottom section A into the water-resistant groove in the wall mounting frame.
Figure 19:
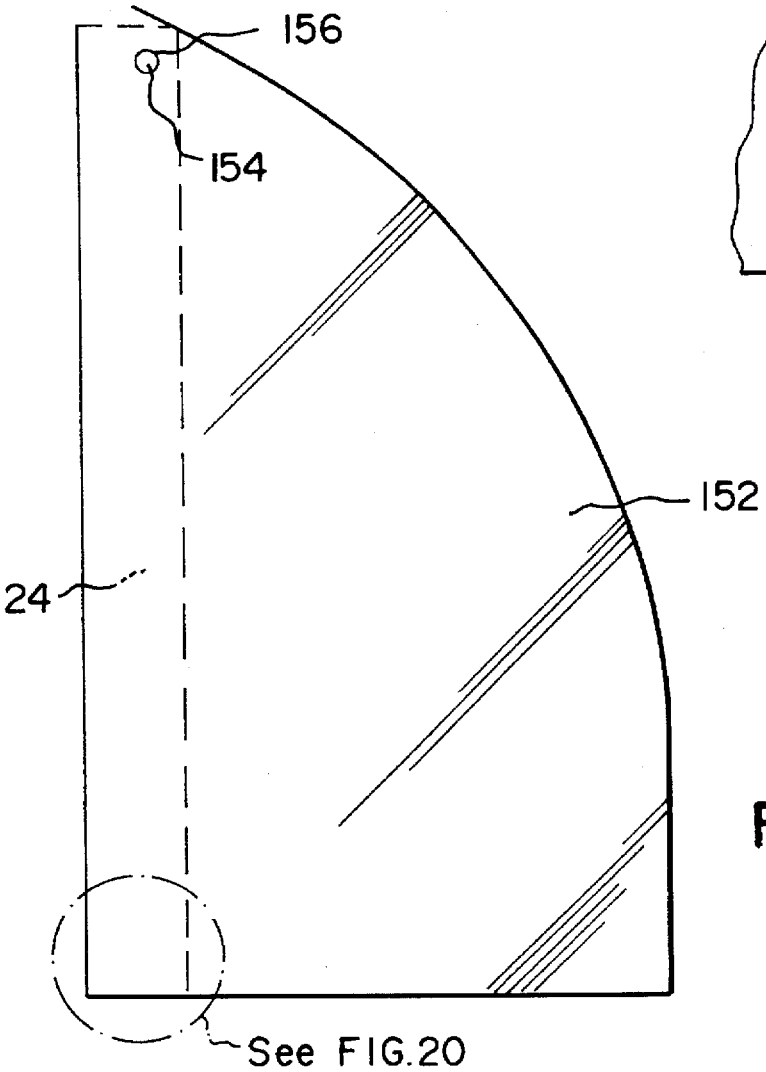
FIG. 19 is a side elevational view of a further embodiment in which the sloping side walls are incorporated into the sloping cover.

The pivotal sloping cover in the best mode embodiment is illustrated in FIGS. 1, 2, 6, 7, 10, 11, 16 and 18 where the pivotal sloping cover slopes downwardly in a corresponding slope to corresponding projecting sides from the wall mounting frame. Alternatively, the pivotal sloping cover can include either the perpendicular triangular-shaped sides or rounded sloping sides that slope downwardly and laterally to engage a closure in the wall mounting frame sloping to provide a water-resistant closure as illustrated in FIGS. 17, 19 and 20. In the preferred embodiment of the invention it is preferable to have a pivotal sloping cover with sloping sides projecting from the wall mounting frame since in this embodiment the invention can be readily adapted to its multifunctional application as a water-resistant soap dish closure as well as a decorative and coordinated bathroom tissue cover as will be described hereinafter in greater detail.

Referring now to FIGS. 1–11 the novel water-resistant multifunctional bathroom fixture 20 is illustrated having a downwardly sloping cover 22 attached to mounting bracket or wall mounting frame 24. Wall mounting frame 24 includes a soap shelf support 26 extending substantially perpendicular from wall mounting frame 24. Wall mounting frame 24 in this embodiment also includes a pair of triangular-shaped sloping sides 28 and 30 which at the bottom end 32 (FIG. 2) extend to at or near the width of projecting soap shelf support 26. Sides 28 and 30 slope from the bottom end 32 to the upper end 34 which is substantially coextensive with the thickness of wall mounting bracket 24.

Figure 1:
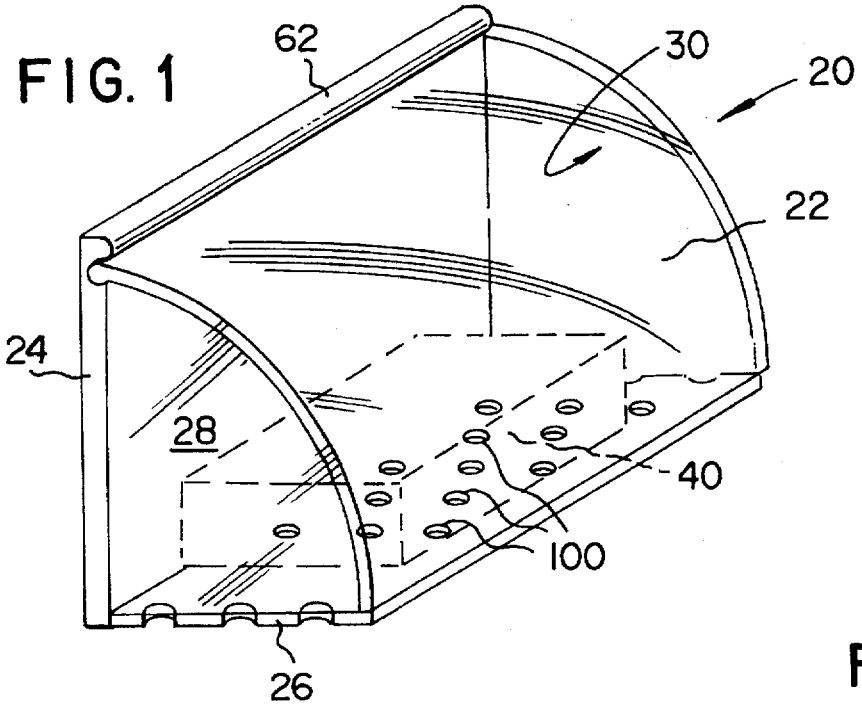
FIG. 1 is a perspective view of the preferred embodiment of a novel multifunctional water-resistant bathroom device constructed in accordance with the invention.
Figure 3:
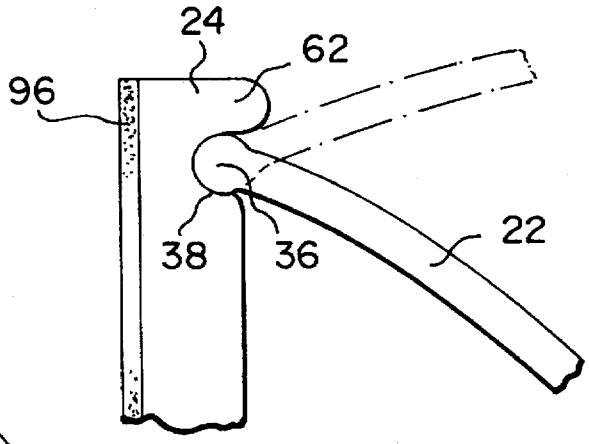
FIG. 3 is a fragmentary side view of the pivotal sloping cover and wall mounting frame.

Downwardly sloping cover 22 terminates in a cylindrical-shaped end 36 which mates with a socket-shaped opening 38 in wall mounting frame 24 (FIG. 3). Pivotal sloping cover 22 pivots from a closed position (FIGS. 1 and 2) to an open position (FIGS. 3, 4 and 5) by the combination of the cylindrical-shaped end 36 pivoting in socket-shaped opening 38. The pivoting of pivotable sloping cover 22 from its open position to its closed position is accomplished by the combination of cylindrical-shaped end 36 pivoting in socket-shaped opening 38 which may include means for maintaining pivotal cover 22 in an open position during periods when bar of soap 40 is being used in the shower or bathtub.

Figure 4:
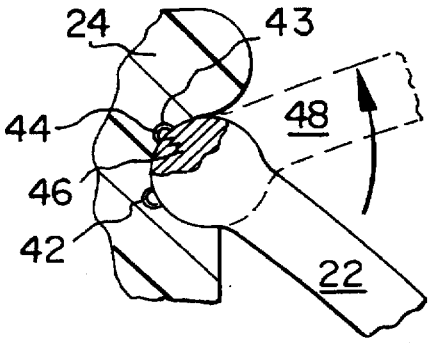
FIG. 4 is a fragmentary side view of the cylinder and socket attachment of the sloping cover to the wall mounting frame.
Figure 5:
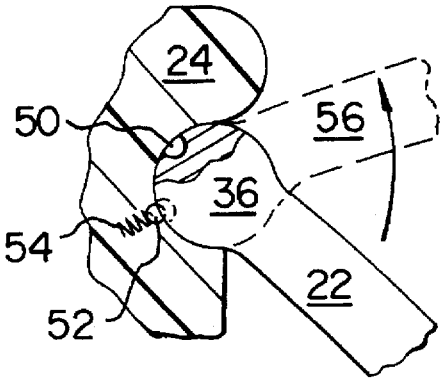
FIG. 5 is an alternative embodiment of the cylinder and socket type attachment of the sloping cover to the wall mounting frame or means.

As illustrated in FIGS. 3, 4 and 5 the means for maintaining pivotable cover 22 in its open position or closed position can be accomplished by providing a groove or detente 42 corresponding to the open position in mounting bracket 24 and a groove or detente 43 corresponding to the closed position in combination with a spring-biased rod 44 activated by spring 46 in cylindrical-shaped end 36 so that pivoting of pivotal cover 22 to the position 48 as illustrated in phantom in FIG. 4 results in the spring-biasing of spring-biased rod 44 into detente 42 to maintain pivotable cover 22 in its open position. Similarly pivotable cover 22 can be secured in a closed position when pivotable cover is lowered by the spring-biasing of spring-biased rod 44 into detente 43 to maintain pivotable sloping cover in a closed position to assist in the water-resistant sealing provided between the sloping cover and wall mounting bracket as will be discussed with regard to FIGS. 6, 7 and 20. In the preferred embodiment of the invention a detente 50 is provided along the length of cylindrical-shaped end 36 and a spring-loaded biasing rod 52 is activated by a leaf-spring 54 to push rod 52 into detente 50 to maintain pivotal cover 22 in open position 56 as indicated in phantom in FIG. 5. The application of a leaf spring 54 and rod 52 combination in the embodiment as illustrated in FIG. 5 is particularly useful, where pivotal cover 22 has a heavier weight due to the material of its construction or has a relatively larger mass as a result of the incorporation of sides 28 and 30 as part of pivotal downwardly sloping cover 22 as illustrated in FIGS. 17 and 19 as will be described hereinafter in greater detail. The pivotable sloping cover 22 as well as mounting bracket 24 may be made of metal, plastic or other rigid material or combinations thereof but should be not so thick or heavy as to require unreasonable thickness or weight as to prevent lightweight utilitarian applications to the bathroom environment.

Figure 6:
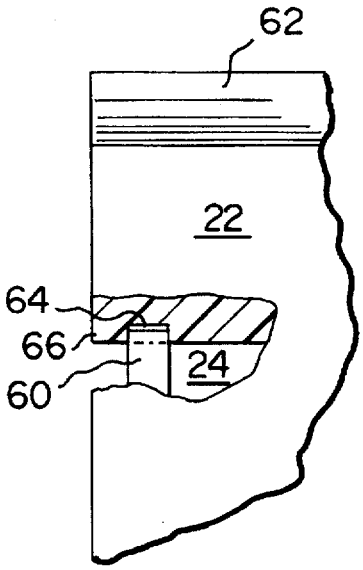
FIG. 6 is a top fragmentary view illustrating the relationship between the sloping cover and sloping sides.
Figure 7:
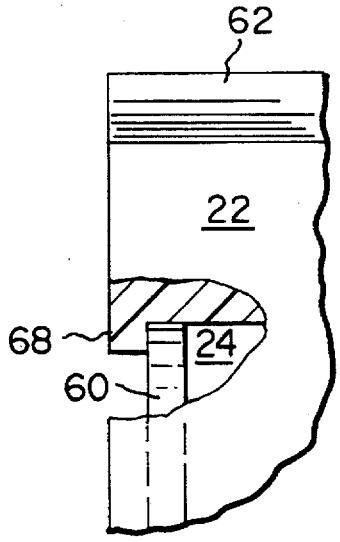
FIG. 7 is a top fragmentary view illustrating a further embodiment for maintaining a water-resistant closure between the pivotal sloping cover and sloping sides.
Figure 8:
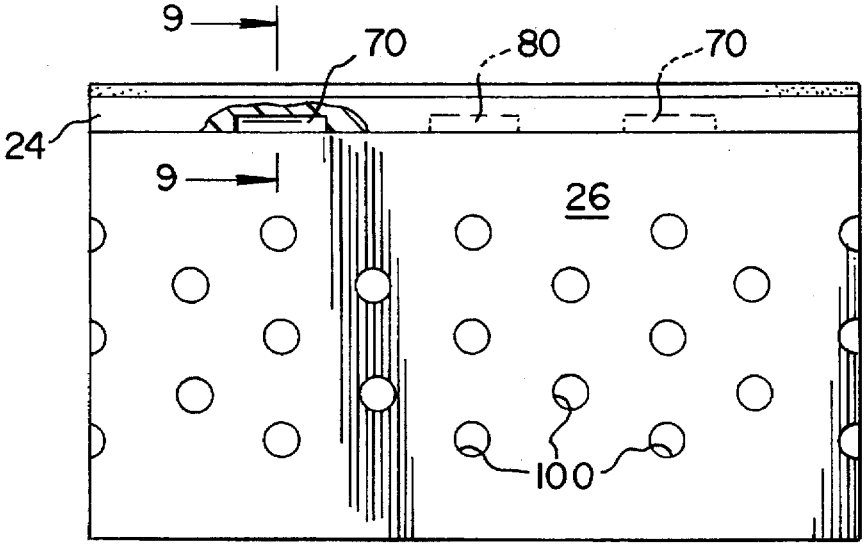
FIG. 8 is a top plan view partly in section of a removable soap shelf.
Figure 9:
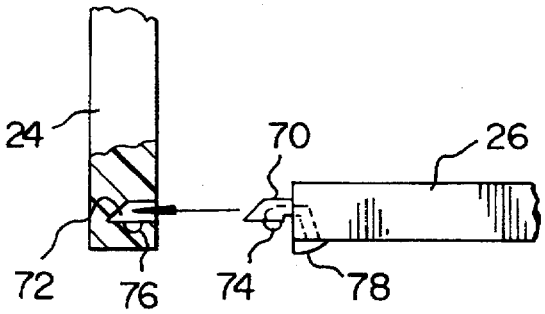
FIG. 9 is a fragmentary side elevational view taken along the lines 9—9 of FIG. 8.

The water-resistant advantages of the novel multifunctional bathroom fixture are in the best mode achieved through the utilization of generally triangular-shaped sides 28 and 30 attached to wall mounting frame 24 where pivotal sloping cover 22 extends laterally over the sloping edges 60 of sides 28 and 30 as illustrated in FIGS. 6 and 7. The attachment of sloping sides to mounting bracket 24 not only makes sloping cover 22 lighter but it also provides additional support for the weight of sloping cover 22 and allows additional weight to be placed on the sloping cover in the form of a shelf on the outside of the cover as will be described hereinafter in greater detail with regard to FIG. 18. In addition the attachment of sloping sides 28 and 30 to mounting bracket 24 assists in applications of the novel water-resistant bathroom fixture to other applications in the bathroom environment as will be described with reference to FIG. 11.

The water-resistant advantages are enhanced by the combination of pivotable sloping cover 22 in combination with the cylindrical-shaped end 36 and socket-shaped opening 38 as heretofore described together with a water-deflecting ledge 62 which deflects water over the top surface of sloping pivotal cover 22 and which prevents water from entering through the sides 28 and 30 by the extension of pivotal sloping cover 22 over the sloping edges 60 of sloping sides 28 and 30 as illustrated in FIG. 6. Sloping cover 22 may optionally include a groove 64 to maintain the water-resistant nature of the novel water-resistant multifunctional water-resistant bathroom fixture 20 of the invention. Overhang 66 also assists in preventing the entry of water into the closure as illustrated in FIG. 6. Optionally a water-resistant lip 68 as illustrated in FIG. 7 may be provided in sloping cover 22 to maintain the water-resistant advantages of the novel multifunctional water-resistant bathroom fixture of the invention.

Referring now to FIGS. 8, 9, 10 and 11, soap shelf support 26 is illustrated in its removable embodiment, wherein soap shelf support 26 includes one or more slotted projections 70 for fitting into a corresponding slot 72 in wall mounting frame 24. Projections 70 may further include a spring-actuated locking pin 74 for locking projection 70 into a corresponding groove 76 in wall mounting frame 24. Spring-activated locking pin 74 may be raised or lowered by a button 78 on the underside of shelf support 26 to raise or lower locking pin 74 in corresponding groove 76. Locking pin 74 assists in the removal, attachment and positioning of shelf support 26 securely with respect to wall mounting frame or bracket 24. In the preferred embodiment two slotted projections 70 are provided each of which include a spring-actuated locking pin 74 with an actuating button 78. A series of support projections may be provided to mate with support slots 80 at other locations across the length of shelf support 26 to provide further strength.

Figure 11:
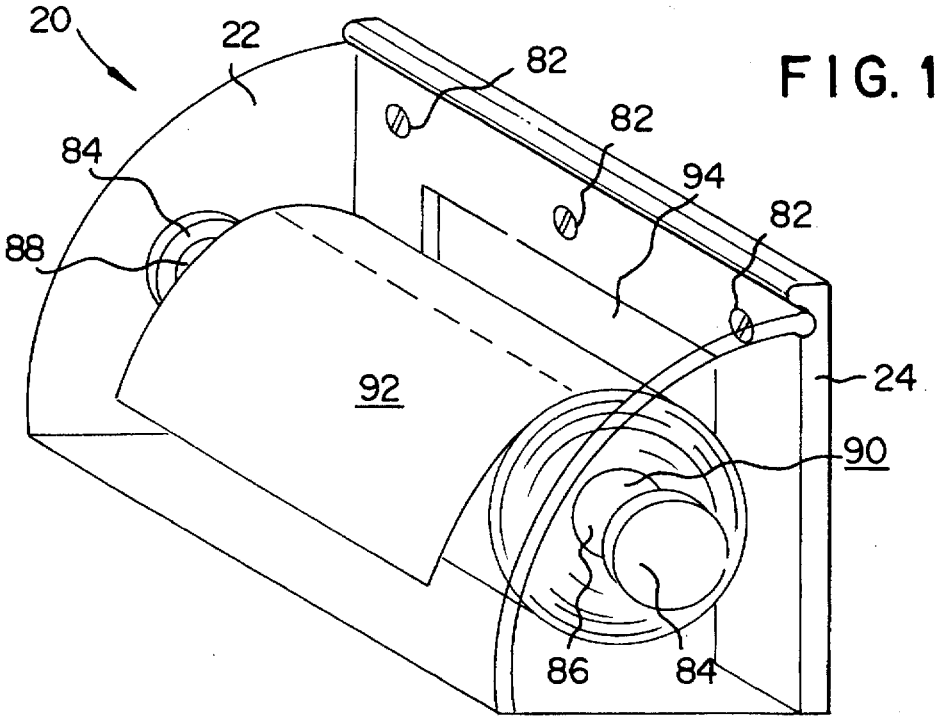
FIG. 11 is a perspective view of the application of the novel multifunctional bathroom device for use as a cover for protecting bathroom tissue.

The removability of shelf support 26 imparts additional advantages to the novel multifunctional bathroom fixture in allowing the wall mounting frame 24 and sloping cover 22 to be utilized without shelf support 26 for other purposes such as decorative coordination in the bathroom and to provide a water-resistant cover for bathroom toilet tissue as illustrated in FIG. 11. As illustrated in FIG. 11 wall mounting frame or bracket 24 can be attached to the walls via screws 82. Sides 28 and 30 may include circular indentations 84 for capturing the ends 86 and 88 of an expandable bathroom tissue roller 90 to hold a roll of bathroom tissue 92 in place. Alternatively, the utilization of the multifunctional bathroom fixture may be accomplished by merely attaching wall mounting frame 24 around a standard bathroom tissue holder fixture in which expandable bathroom tissue roller 90 is held by a standard bathroom toilet paper fixture (not shown) which projects through opening 94 of frame 24.

Figure 2:
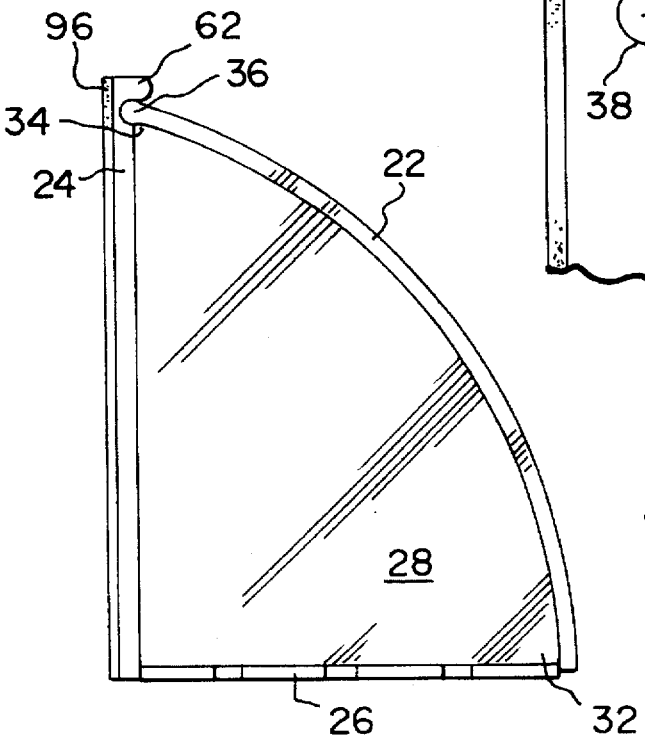
FIG. 2 is a side elevational view of FIG. 1.

It has been found that most standard bathroom fixtures utilize a 4½ inch roll of bathroom tissue and the expandable bathroom tissue roller 90 expands 1 to 3 inches so that the overall dimensions of the standard bathroom toilet tissue holder is about 7¾ inches wide and projects out about 2 inches so that opening 94 can be about 8 inches in length to cover the standard bathroom toilet tissue holder. In addition the novel multifunctional bathroom fixture can also be used in other places in the bathroom environment to provide a water-resistant compartment to keep various objects while providing a useful color-coordinated and decorative device. In addition the wall mounting frame 24 may be attached to the walls utilizing screws 82 or using an adhesive 96 as illustrated in FIG. 2.

Referring now to FIGS. 8, 10, 12, 13, 14 and 15, the advantages of the invention in maintaining the water-resistant compartment with provision for drying and removal of moisture from wet bars of soap placed in the novel bathroom fixture may be achieved with not only the overhangs and water-resistant closure between the sloping cover and the mounting bracket but also by the utilization of drainage holes 100 (FIGS. 8, 14) alone or in combination with drainage channels 102 (FIG. 15). Drainage may also be achieved utilizing various grooved and ribbed surfaces 104 together with a raised, ribbed surface 106 (FIG. 10) alone or together with the tilting of soap shelf support 26 with respect to wall mounting frame or bracket 24, as illustrated in FIG. 14.

Figure 10:
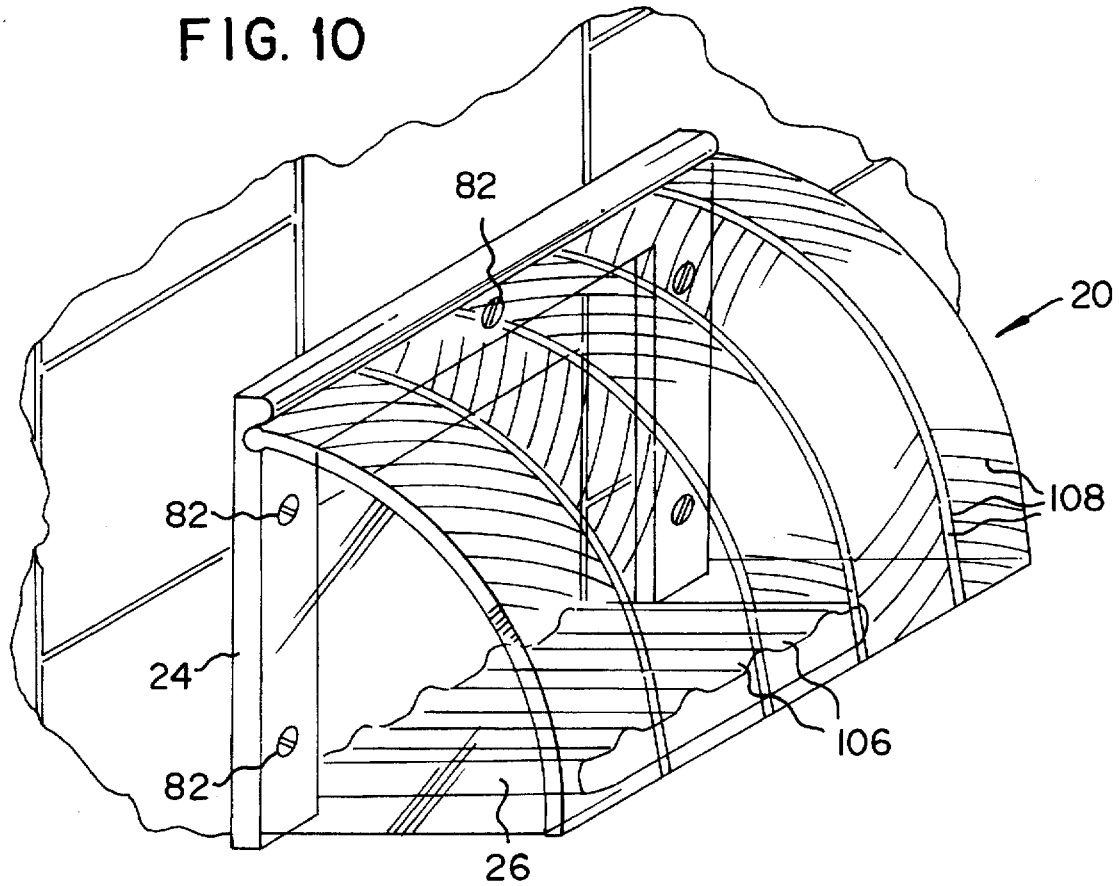
FIG. 10 is a perspective view of the novel water-resistant multifunctional bathroom device with exterior water channels on the pivotal sloping cover.

Drainage holes and channels alone or together with tilting of soap shelf 26 assist in the rapid removal of water from wet soap after it has been used by a person taking a shower or bath. In addition sloping cover 22 may also include water channels 108 over the upper surface as illustrated in FIG. 10. The utility of the novel bathroom fixture may be further increased by the provision of brackets 110 and 112 which may be removable and may be utilized to hold a second bar of soap 114 inside water-resistant multifunctional bathroom fixture 20.

Figure 16:
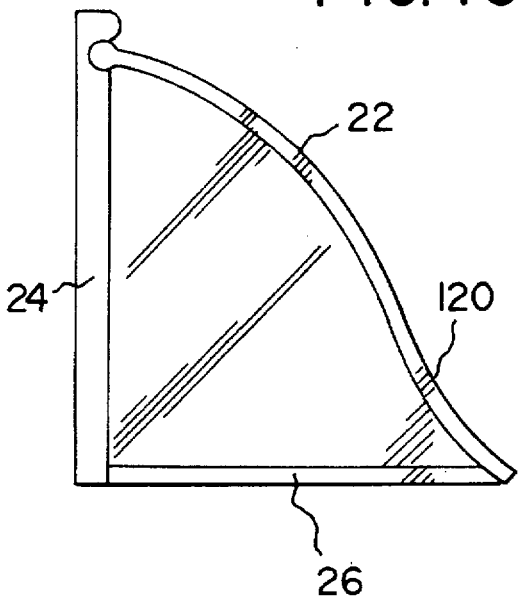
FIG. 16 is a side elevational view of an alternative embodiment for the sloping side walls and pivotal sloping cover.
Figure 17:
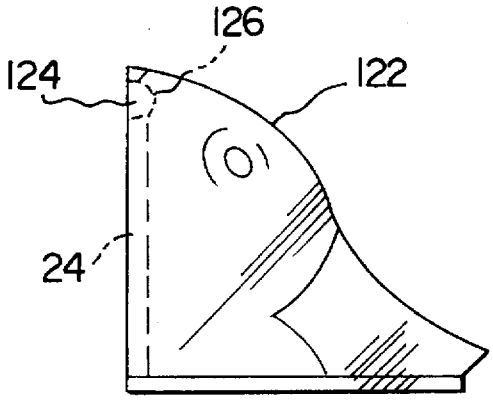
FIG. 17 is a decorative application of the novel multifunctional water-resistant bathroom fixture having sloping side cover and walls.
Figure 18:
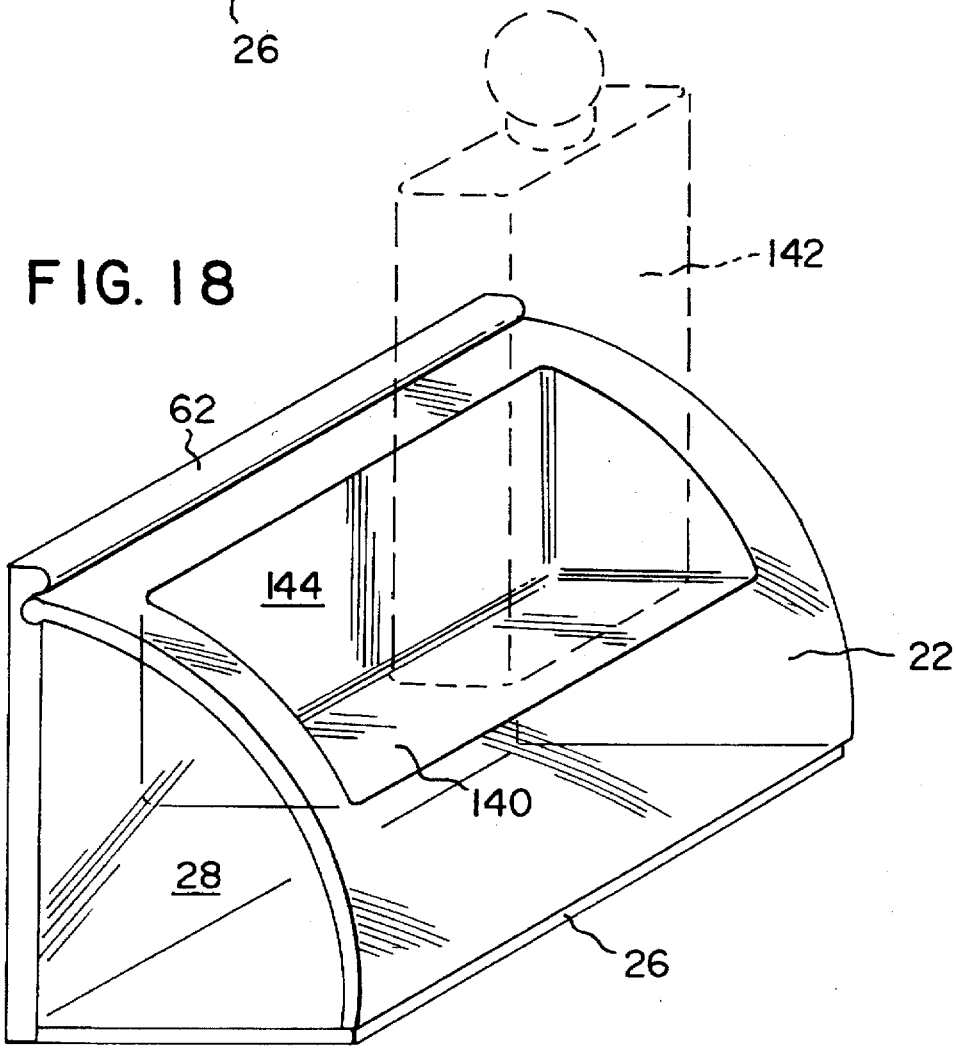
FIG. 18 is a perspective view illustrating a further embodiment for the exterior modification to the sloping side cover to provide additional storage and shelf space.

Referring now to FIG. 16 the pivotal sloping cover 22 may be of a configuration other than a curvilinear configuration as illustrated in FIGS. 1, 2, 10 and 11. As illustrated in FIG. 16 the slope of pivotal sloping cover may include both a positive curvature and a negative curvature 120 to provide an S-shaped pivotal sloping cover. In addition the sloping cover can slope not only downwardly as illustrated in FIGS. 1, 2, 10, 11 and 16, but may also slope downwardly and laterally to wrap around the sides and eliminate the necessity of sloping sides 28 and 30 as illustrated in FIG. 17. It is also possible to utilize sloping cover 122 as illustrated in FIG. 17 with sloping and tapered sides 28 and 30 so that sloping cover 122 covers sloping and tapered sides 28 and 30 to provide an overlapping water-resistant closure. Sloping cover 122, as illustrated in FIG. 17, slopes laterally and downwardly, as illustrated in FIG. 17 so that sides 28 and 30 are integrated into part of sloping cover 122 so that sides 28 and 30 are part of the pivotal sloping cover and the water-resistant closure is provided between wall mounting bracket 24 and sloping cover 122. In this arrangement pivoting is achieved by a retaining pin 124 in wall mounting bracket 24 so that sloping cover 122 is attached internally by a bracket 126 in sloping cover 122 to attach sloping cover 122 onto wall mounting frame or bracket 24.

The novel water-resistant bathroom fixture may be modified in a number of ways to increase its utility such as the provision of an external shelf 140 for holding a shampoo bottle 142 or other objects such as razors or other items used in the bathroom on the outside of the water-resistant closure to increase the utility of the novel bathroom fixture device. The external shelf 140 can be provided by molding a shelf 140 into the cover 22 to provide a substantially flat back surface 144 to assist in storing objects on shelf 140.

Referring now to FIGS. 19 and 20 a further embodiment of the novel water-resistant multifunctional bathroom fixture is illustrated having a sloping cover 152 and a mounting frame bracket 24. Sloping cover 152 is attached to mounting bracket 24 by a retaining pin 154 extending from bracket 24 into a corresponding opening 156 in side 158 attached to and carried as part of sloping cover 152. Sloping cover 152 may include means for holding sloping cover 152 in an open position similar to the means described with respect to FIGS. 3, 4 and 5. The edges 160 of sloping cover are designed to nest into a water-resistant lip 162 provided in mounting bracket 24 to provide a water-resistant closure between sloping cover 152 and mounting bracket 24. The utilization of means to keep sloping cover 152 in a closed position similar to that described in reference to FIG. 4 assists in providing a water-resistant closure by maintaining water-resistant lip 162 in contact with mounting bracket 24. In addition the utilization of drainage holes 100 and drainage channels 102 in soap shelf support assist in the drying of wet soap placed in the water-resistant multi-functional bathroom fixture.

As will be recognized by those skilled in the art the invention may be modified in a number of ways for various applications in utilizing the novel water-resistant bathroom fixture of the invention. The exterior of the pivotal sloping cover can be modified to provide water channels or grooves alone or in combination with shelf storage areas. The soap support shelf may be angled to assist in channelling water away from the novel water-resistant bathroom fixture. The sides of the sloping cover can be modified to include sides which mate with the wall mounting frame to form a water-resistant closure with the wall mounting frame or the pivotal sloping cover can form a water-resistant closure with complementary sloping sides extending from the wall mounting frame or bracket. In addition the channelling of water away from wet soap placed in the novel water-resistant fixture can be achieved by channelling and drainage passages and drying holes as has heretofore been discussed to further enhance the aspects of the invention.

The invention may be implemented in a variety of ways by those skilled in the art including the utilization of removable brackets and a removable soap shelf support to provide a number of applications in the bathroom environment. In addition the exterior sloping cover is also susceptible to a wide variety of decorative applications in the bathroom. These and other modifications of the invention may be readily accomplished by those skilled in the art. It will be appreciated that these and other modifications may be made without departing from the spirit and scope of the invention as defined in the following claims:

What is claimed is:

1. A multifunctional bathroom device comprising:

(a) a wall attachment mounting frame for mounting to a wall;

(b) a shelf extending substantially perpendicular from said wall attachment mounting frame;

(c) a sloping cover for covering said wall attachment mounting frame and said shelf;

(d) means for the pivotal attachment of said sloping cover to said wall attachment mounting frame;

(e) a spring-actuated bar and detente combination for periodically maintaining said pivotable sloping cover in an open position; and (f) a water-resistant closure means formed between said sloping cover and said wall attachment frame.

2. The multifunctional bathroom device of claim 1 wherein said shelf is removable from said wall attachment mounting frame.

3. The multifunctional bathroom device of claim 2 wherein said shelf includes spring-biased locking means for locking said removable shelf into said wall attachment mounting frame.

4. The multifunctional bathroom device of claim 2 wherein said water-resistant closure means includes a lip on said sloping cover for covering corresponding sloping side walls attached to said wall mounting frame.

5. The multifunctional bathroom device of claim 1 wherein said spring actuated bar is disposed on said wall attachment mounting frame.

6. The multifunctional bathroom device of claim 1 wherein said spring actuated bar is disposed on said sloping cover.

7. A water-resistant multifunctional soap dish comprising:

(a) a wall mounting frame having an upper end and a lower end;

(b) a substantially perpendicular shelf extending from said lower end of said wall mounting frame;

(c) a pair of side walls mounted on said wall mounting frame said pair of side walls extending outwardly from said lower end of said wall mounting frame to a distance substantially equivalent to the length of said substantially perpendicular shelf, said pair of side walls having sloping edges sloping from said lower end of said mounting frame to said upper end of said wall mounting frame;

(d) a pivotable sloping cover sloping to correspond to said sloping edges of said pair of side walls, said pivotable sloping cover being held in its closed position by its own weight;

(e) pivotal attachment means for pivotally attaching said pivotable sloping cover to said wall mounting frame; and (f) a spring biased rod and groove combination for periodically maintaining said pivotable sloping cover in an open position.

8. The water-resistant multifunctional soap dish of claim 7 wherein said spring biased rod is disposed in said wall mounting frame.

9. The water-resistant multifunctional soap dish of claim 8 wherein said substantially perpendicular shelf is removable from said wall mounting frame.

10. The water-resistant multifunctional soap dish of claim 9 wherein said removable shelf includes spring-biased means for locking said removable shelf into said wall mounting frame.

11. The water-resistant multifunctional soap dish of claim 8 wherein said substantially perpendicular extending shelf includes water drainage means.

12. The water-resistant multifunctional soap dish of claim 11 wherein said water drainage means includes a tilting of said substantially perpendicular extending shelf.

13. The water-resistant multifunctional soap dish of claim 11 wherein said water drainage means includes drainage holes.

14. The water-resistant multifunctional soap dish of claim 7 wherein said spring biased rod is disposed on said pivotable sloping cover.

15. A water-resistant soap dish comprising:

(a) wall mounting means having sloping sides sloping outwardly and downwardly from the upper end of the wall mounting means to the lower end of the wall mounting means said sloping sides having inside edges;

(b) a shelf extending substantially perpendicularly from said wall mounting means to a distance substantially equal to the distance said sloping sides extend from said lower end of said wall mounting means;

(c) a pivotable sloping cover sloping to correspond to said sloping sides, said pivotable sloping cover extending laterally to and beyond the inside edges of said sloping sides, said pivotable sloping cover being held in its closed position by its own weight;

(d) means for the pivotal attachment of said pivotal sloping cover to said wall mounting means; and (e) a spring biased rod and groove combination for periodically maintaining said pivotable sloping cover in an open position.

16. The water-resistant soap dish of claim 15 wherein said spring biased rod is disposed on said pivotable sloping cover.

17. The water-resistant soap dish of claim 16 wherein said shelf is removable.

18. The water-resistant soap dish of claim 15 wherein said spring biased rod is disposed on said wall mounting means.

* * * * *